US007150638B1

(12) United States Patent
Fonville et al.

(10) Patent No.: US 7,150,638 B1
(45) Date of Patent: Dec. 19, 2006

(54) COVER DEVICE AND METHOD FOR ELECTRICAL CONNECTOR

(75) Inventors: Carl E. Fonville, Ann Arbor, MI (US); Roland C. Hawkins, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/218,247

(22) Filed: Sep. 1, 2005

(51) Int. Cl.
*H01R 13/44* (2006.01)

(52) U.S. Cl. ..... 439/148; 439/135; 439/289; 439/912

(58) Field of Classification Search ..... 439/148, 439/135, 289, 912
See application file for complete search history.

(56) References Cited

U.S. PATENT DOCUMENTS 2,428,323 A * 9/1947 Winer ..... 174/77 R
5,015,946 A * 5/1991 Janko ..... 324/754
6,682,356 B1 * 1/2004 Erez et al. ..... 439/108

* cited by examiner

*Primary Examiner*—Tho D. Ta
(74) *Attorney, Agent, or Firm*—Christopher DeVries

(57) ABSTRACT

A detachable device for covering an end of an electrical connector, comprising a non-conductive cover, sealingly attachable, and completely covering the mating end of the connector. An external end of the cover is generally planar with electrically conductive pads corresponding to the conductive terminals of the connector, and electrically connecting the pads to the terminals. The electrically conductive pads are arranged in a pattern, oriented to provide a single line-of-sight for machine recognition.

21 Claims, 2 Drawing Sheets

COVER DEVICE AND METHOD FOR ELECTRICAL CONNECTOR

TECHNICAL FIELD

This invention pertains generally to electrical connectors, and more specifically to a device and method to cover a connector.

BACKGROUND OF THE INVENTION

Electrical connectors are employed in various applications to provide ready attachment of a component into a system, and subsequent detachment when appropriate or necessary, such as for component service, testing, or replacement. An electrical connector is operable to transmit electrical information between the system and the component, and is often an integral element of a wiring harness. A connector has requirements for quality, reliability, and durability, related to the specific application and environmental conditions. An electrical connector may be expected to provide connectors for wiring systems which transmit analog and digital electrical signal data, electrical power, and electrical grounding.

An electrical connector may be assembled in one location, and transported to a second location for assembly to a component. The component, with the assembled electrical connector may be transported to a third location for assembly into a subsystem. The subsystem may then be transported to a fourth location for assembly into a final product. At each location, there are typically requirements for testing and evaluation of the connector, component, subsystem, and final product. An example of this occurs with a connector intended for assembly onto an internal combustion engine component, such as an ignition module or electronic sensor. The component is assembled with the connector and tested. The component is transported to the engine plant for assembly into the engine, which is subsequently tested. The engine is transported to a vehicle assembly plant for assembly into a vehicle. The electrical connector is exposed to various environmental conditions that could affect its mechanical and electrical integrity, during transport, and more likely, in each subsequent manufacturing facility.

Testing is typically required at each stage of the manufacturing and assembly process, requiring some form of electrical connection to the connector. The connection is accomplished manually or via an automated machine which finds the connector and connects thereto. When an automated machine is employed to connect to a connector, there must be a machine-recognizable element to the connector design for identification. When orientation of the connector and the connector terminals are not in a direct line-of-sight, the automated machine may require multiple axis articulation capability to establish effective contact with the connector terminals. Holding tight manufacturing tolerances for connector terminals is also required to permit effective contact. There is a risk of harm to the connector each time it has contact with an outside device or machine.

Therefore, there is a need for a device that protects a connector for a component from damage prior to the component being assembled into a final end-product. There is a further need to be able to have electrical contact with the component through any protective device, and a need for the protective device to be identified and readily contact, electrically, an automated device operable to test and measure the component through the connector.

SUMMARY OF THE INVENTION

In accordance with the present invention, the device comprises a removable electrical connector cover having external electrical conductive elements, and providing a single direct line-of-sight along a convenient axis of the external conductive pads. When the invention is used in conjunction with an external testing tool having electrical probes, a simple single axis probe replaces a multiple-axis articulating probe tooling for testing. The conductive pads on the exterior of the connector cover can be made appropriately large to reduce a need for precise targeting of probes of the testing tool. The conductive pads are preferably oriented on the exterior of the connector cover in a manner that provides optimum access to probes of the testing tool. The connector cover is operable to protect the internal connector pins from external contamination. The probes of the testing tool do not have physical contact with the terminal pins of the connector, thus eliminating risk of damage. The removable cover is preferably installed at the connector manufacturing plant, and subsequently removed, and disposed of, at final assembly.

Therefore, accordance with the present invention, there is a device for covering a mating end of an electrical connector having at least one conductive terminal. The device includes a non-conductive cover that protects the electrical connector and which substantially completely covers the mating end of the electrical connector. An external end of the non-conductive cover is generally planar and has electrically conductive pads corresponding to one of the conductive terminals of the connector, with electrically conductive means for connecting each of the conductive pads to one of the corresponding conductive terminals of the connector. The device, including the non-conductive cover, is subsequently detachable.

Another aspect of the invention is the device being constructed of recyclable material, and being disposable, or alternatively, reusable.

Another aspect of the invention is the device being subsequently detachable, and removable by hand.

Another aspect of the invention is the device having a flange of the internal end mechanically interferingly fitting with the electrical connector.

Another aspect of the invention is the device welded to the electrical connector, or alternatively, molded as an integral element of the body of the electrical connector.

Another aspect of the invention is the device comprises the internal end of the cover having at least one protrusion, each protrusion corresponding to at least one of the terminals of the connector, and, each protrusion mechanically interferingly fitting with the corresponding terminal.

Another aspect of the invention is the device wherein the electrically conductive means comprises a plurality of conductive strips, each operable to conduct electrical information between one of the conductive pads and one of the corresponding conductive terminals of the connector.

Another aspect of the invention is the conductive strips constructed of a base metal foil, or alternatively, constructed of a conductive ink, or, of conductive polymer material.

Another aspect of the invention is the conductive strips operable to conduct electrical information in the form of analog electrical signal information, or alternatively, in the form of digital electrical signal information, or, electrical power.

Another aspect of the invention is the device comprises the electrically conductive pads arranged in a pattern and oriented to provide a single line-of-sight for machine recognition.

Another aspect of the invention is the device comprises a method to seal the mating end of the electrical connector, utilizing the aforementioned and described device.

Another aspect of the invention comprises electrically mating an external probe device to each of the electrically conductive pads of the device to determine electrical integrity of the connector and the component with the probe device.

Another aspect of the invention is that the contact pattern may lie on multiple surfaces of the cover in order to provide improved locating registration for single line-of-sight for machine recognition or to allow a common component to have multiple lines-of-sight, one for each intended usage.

These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF AN EMBODIMENT

Figure 1:
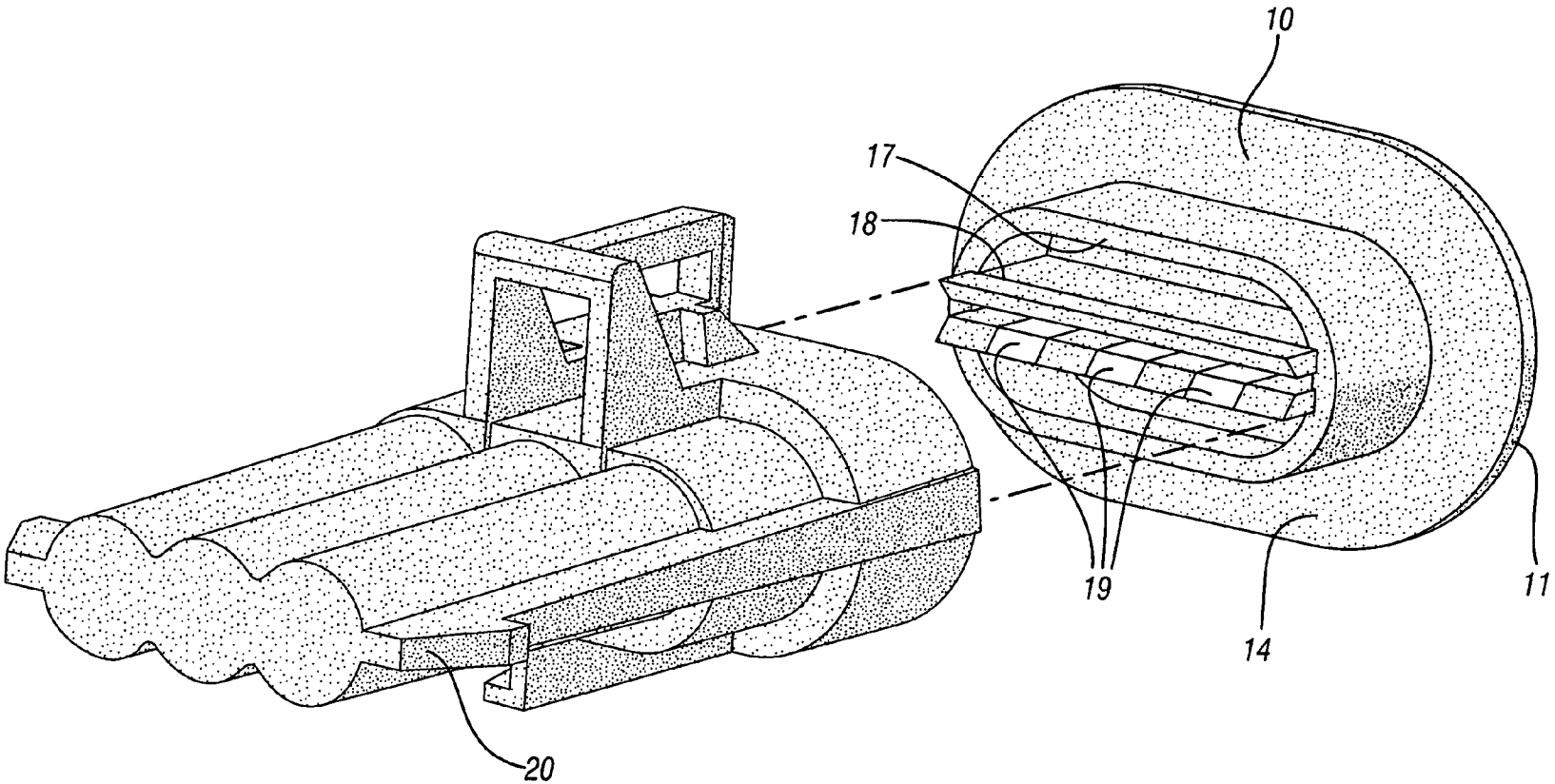
FIG. 1 is a first perspective view of the device, in accordance with the present invention; and, FIG. 2 is a second perspective view of the device, in accordance with the present invention.
Figure 2:
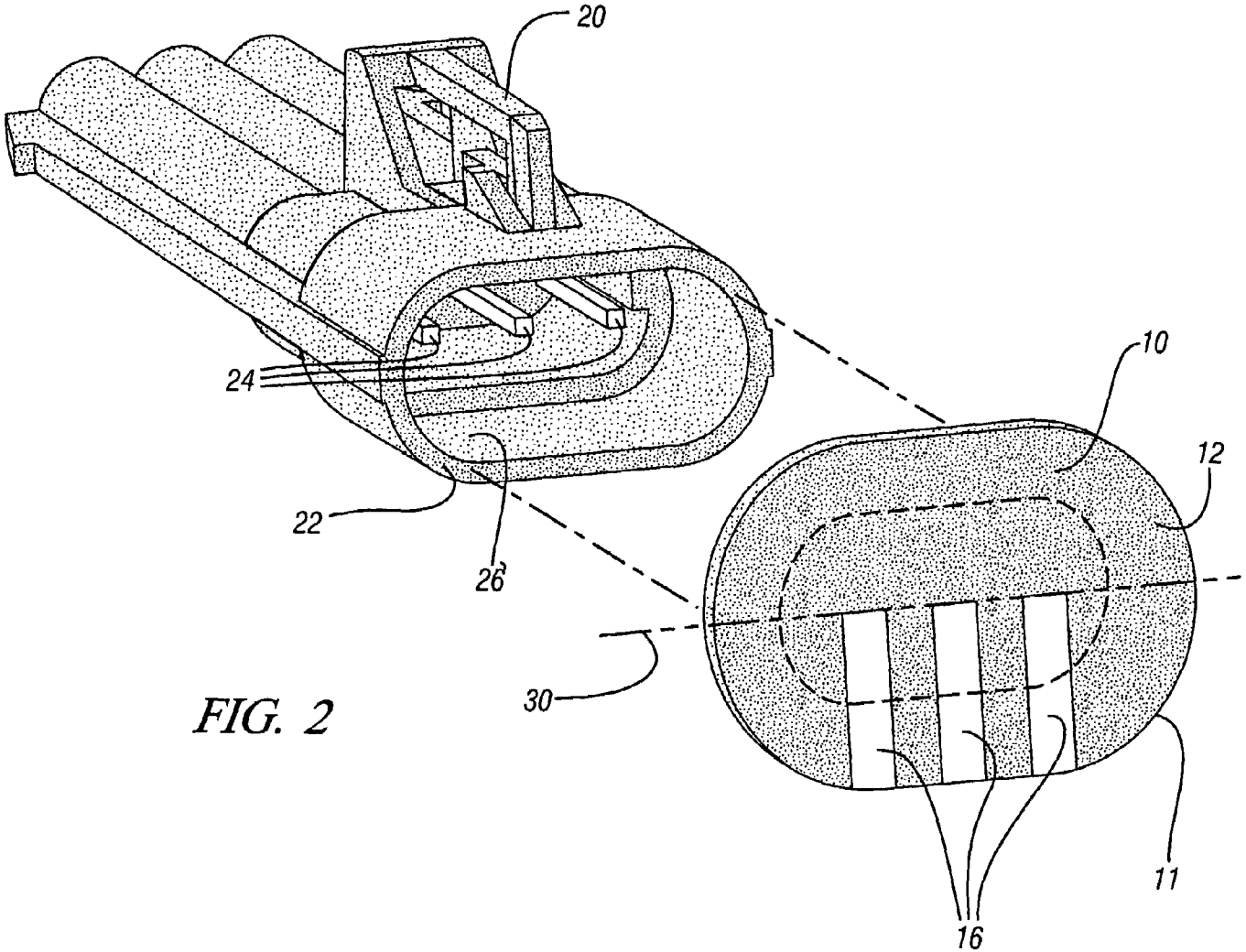

Referring now to the drawings, wherein the showings are for the purpose of illustrating the invention only and not for the purpose of limiting the same, FIGS. 1 and 2 show first and second perspective views of an exemplary device, which has been constructed in accordance with an embodiment of the present invention.

The device 10 provides a covering for a mating end 22 of an electrical connector 20 having conductive terminals 24. The electrical connector 20 shown is a conventional connector having three male conductive terminals arranged in a single plane. A typical application for the electrical connector is for an automotive component device, although the invention is not intended to be so limited.

The device 10 has an external end 12 and an internal end 14, and is attachable to the mating end 22 of the electrical connector 20. When the device is attached to the electrical connector, it substantially completely covers the end 22 and creates an environmental seal thereto, effectively sealing the open mating end 22 of the connector 20. The device includes a cover 11 made of non-electrically conductive material that is low-cost, readily recycled, is readily moldable, with elasticity properties that allow sufficient amount of pliability. The exemplary material comprises polypropylene, although other materials with similar properties are acceptable.

The external end 12 of the non-conductive cover 11, as shown, is generally planar in aspect, with an external shape that conforms to the outer cross-sectional circumference of the mating end 22 of the connector 20. The dimensions of the external end 12 are preferably sufficiently large enough to prevent inadvertent assembly of the connector 20 to a mating connector (not shown) with the device 10 in place. There is a plurality of electrically conductive pads 16 attached to the external end 12 of the non-conductive cover 11. Each conductive pad 16 corresponds to one of the conductive terminals 24 of the connector 20. The electrically conductive pads 16 are preferably arranged and oriented along a single axis 30, thus facilitating orientation and connection of probes of an external testing tool (not shown).

The internal end 14 of the device is designed to fit with the electrical connector 20, creating a mechanical seal with the connector end and having electrical connections to each of the connector terminals 24. A flange 17 protrudes orthogonally from the generally planar surface of the cover, having a shape conforming to an inner surface 26 of the connector end, and mechanically interferingly fitting around the inner circumference of the connector end when the cover is assembled onto the connector end. There is at least one protrusion 18 on the inside surface of the device 10, preferably formed during formation of the cover piece of the same material as the cover piece. The protrusion 18 dimensionally corresponds to the terminals of the connector to mechanically interferingly fit with the terminals.

The device 10 includes the electrically conductive pads 16 having electrically conductors for electrically connecting each of the conductive pads 16 to one of the corresponding conductive terminals 24 of the connector 20. The electrically conductors preferably comprise a plurality of conductive strips 19 formed to create an electrical connection from one of the electrically conductive pads 16 to one of the terminals 24. In the embodiment shown, each conductive strip 19 is connected to one of the conductive pads 16, passes through the cover 11 and along protrusion 18 on the inside surface 14 of the device 10, electrically connecting to one of the terminals 24 at the surface wherein the protrusion mechanically interferingly fits with the terminals 24. Each of the plurality of conductive strips 19 is preferably constructed of a base metal foil coated with tin.

Alternatively, each of the plurality of conductive strips 19 is constructed of a conductive ink that is printed so there is created an electrical connection between the conductive pad 16 and corresponding conductive terminal 24. In this embodiment, the conductive pad is preferably manufactured to pass through the cover, and the conductive ink is printed on the inside surface 14 of device 10 along protrusion 18, and electrically connects to one of the terminals 24 at the surface wherein the protrusion mechanically interferingly fits with the terminal 24.

Alternatively, each of the plurality of conductive strips 19 constructed of a conductive polymer material. In this embodiment, the conductive pad and appropriate portions of the protrusion 18 are manufactured of the conductive polymer, so there is created an electrical connection between the conductive strip 19 and corresponding conductive terminal 24. In this embodiment, the conductive pad and portion of protrusion 18 are preferably manufactured using the conductive polymer, to electrically connect one of the terminals 24 at the surface wherein the protrusion mechanically interferingly fits with the terminal 24.

Each conductive strip is operable to conduct electrical signal information, in the form of analog signal data or digital/discrete signal data, between one of the conductive pads and one of the corresponding conductive terminals of the connector. Alternatively, each conductive strip 19 is operable to conduct electrical power, in the form of AC or DC electrical power, between one of the conductive pads and one of the corresponding conductive terminals of the connector. Each conductive strip 24 is preferably designed according to the anticipated type and form of electrical signal to be conducted. Such conductive strip design is known to a skilled practitioner, and not described in detail herein.

The device 10 is manually assembled to the end of the connector 20, or machine assembled, after final inspection of the connector 20, with seal created by the aforementioned mechanical interference fit. Alternatively, the device may be welded to the end of the electrical connector to create a seal, using any one of available technologies to weld plastic pieces, including, for example, localized thermal heating devices, or, contact cement. Alternatively the cover may be molded as an integral element of the body of the electrical connector, and having mechanical scoring to permit manual disassembly.

The device 10 is intended be a disposable item, and made of recyclable material. Alternatively, the device may be reusable, depending upon the specific application and other considerations not considered herein.

The device 10 is subsequently detachable, and preferably readily removable by hand. An operator in a manufacturing facility is able to detach the device 10 immediately prior to final assembly of the connector to a corresponding connector in a wiring harness of an end product.

In constructing the device 10 to provide a cover for the terminal 20 having external conductive pads 16, each of the external conductive pads are able to readily contact corresponding electrical probes of an external testing device. The pads 16 mate electrically to the external testing device at appropriate times during processing of the component and connector 20, permitting the external testing device to test, evaluate, and determine electrical integrity of the connector and corresponding component.

The invention has been described with specific reference to the preferred embodiments and modifications thereto. Further modifications and alterations may occur to others upon reading and understanding the specification. It is intended to include all such modifications and alterations insofar as they come within the scope of the invention.

The invention claimed is:

1. A device for covering a mating end of an electrical connector having at least one conductive terminal, comprising:

a non-conductive cover: sealingly attachable to the electrical connector, substantially completely covering the mating end of the electrical connector, and, having an external end, and, an internal end;

the external end of the non-conductive cover being generally planar, and, having at least one electrically conductive pad, each conductive pad corresponding to a conductive terminal of the connector; and, a plurality of electrical conductors, each connectable to one of the conductive pads to one of the corresponding conductive terminals of the connector;

the conductive terminals of the connector electrically connected to a component; and, the device, including the non-conductive cover, subsequently detachable;

wherein the cover sealingly attachable to the electrical connector comprises a flange of the internal end mechanically interferingly fitting within the electrical connector.

2. The device of claim 1, wherein the device for covering the mating end of the electrical connector having at least one conductive terminal being subsequently detachable comprises the device removable by hand.

3. The device of claim 1, wherein the cover sealingly attachable to the electrical connector comprises the internal end of the cover having at least one protrusion, each protrusion corresponding to at least one of the terminals of the connector, and, each protrusion mechanically interferingly fitting with the corresponding terminal.

4. The device of claim 1, wherein the device for covering the mating end of the electrical connector having at least one conductive terminal is constructed of recyclable material.

5. The device of claim 4, wherein the device for covering the mating end of the electrical connector having at least one conductive terminal is disposable.

6. The device of claim 4, wherein the device for covering the mating end of the electrical connector having at least one conductive terminal is reusable.

7. The device of claim 1, wherein the cover sealingly attachable to the electrical connector comprises the internal end of the cover welded to the electrical connector.

8. The device of claim 7, further comprising the cover molded as an integral element of the body of the electrical connector.

9. The device of claim 1, wherein the plurality of electrical conductors, each connectable to one of the conductive pads to one of the corresponding conductive terminals of the connector, comprises: a plurality of conductive strips, each operable to conduct electrical information between one of the conductive pads and one of the corresponding conductive terminals of the connector.

10. The device of claim 9, wherein each of the plurality of conductive strips is constructed of a base metal foil.

11. The device of claim 9, wherein each of the plurality of conductive strips is constructed of a conductive ink.

12. The device of claim 9, wherein each of the plurality of conductive strips is constructed of a conductive polymer material.

13. The device of claim 9, wherein at least one of the plurality of conductive strips operable to conduct electrical information between one of the conductive pads and one of the corresponding conductive terminals of the connector is operable to conduct analog electrical signal information.

14. The device of claim 9, wherein at least one of the plurality of conductive strips operable to conduct electrical information between one of the conductive pads and one of the corresponding conductive terminals of the connector is operable to conduct digital electrical signal information.

15. The device of claim 9, wherein at least one of the plurality of conductive strips operable to conduct electrical information between one of the conductive pads and one of the corresponding conductive terminals of the connector is operable to conduct electrical power.

16. The device of claim 1, wherein the electrically conductive pads are arranged in a pattern.

17. The device of claim 16, wherein the electrically conductive pads are arranged in a pattern, oriented to provide a single line-of-sight for machine recognition.

18. A method to seal a mating end of an electrical connector, the electrical connector electrically connected to a component, comprising:

mechanically interferingly attaching a device within the mating end of the electrical connector, said device operable to substantially completely cover the mating end of the electrical connector; wherein the device comprises:

a non-conductive cover: sealingly attachable to the electrical connector, substantially completely covering the mating end of the electrical connector, and, having an external end, and, an internal end;

the external end of the non-conductive cover being generally planar, and, having at least one electrically conductive pad, each conductive pad corresponding to one of the conductive terminals of the connector;

an electrically conductive means for connecting each of the conductive pads to one of the corresponding conductive terminals of the connector; and, the non-conductive cover subsequently detachable.

19. The method of claim 18, further comprising:

mating electrically an external probe device to each of the electrically conductive pads of the device; and, determining electrical integrity of the connector and the component with the probe device.

20. The method of claim 18, further comprising mating electrically an external probe device to each of the electrically conductive pads of the device;

conducting electrical power to the component; and, determining electrical integrity of the connector and the component with the probe device.

21. A device for covering a mating end of an electrical connector having at least one conductive terminal, comprising:

a cover, comprising a generally planar surface, an external end, and, an internal end, a flange protruding substantially orthogonally from the generally planar surface of the internal cover having a shape conforming to an inner surface of the mating end of the connector and mechanically interferingly fitting around the inner circumference thereof;

the external end having at least one electrically conductive pad corresponding to a conductive terminal of the connector; and, a plurality of electrical conductors, each operable to connect one of the conductive pads corresponding to one of the conductive terminals of the connector.

* * * * *